US006196107B1

(12) United States Patent
Hoffman et al.

(10) Patent No.: US 6,196,107 B1
(45) Date of Patent: Mar. 6, 2001

(54) EXPLOSIVE CONTAINMENT DEVICE

(75) Inventors: William A. Hoffman, Lanham; David T. Wilson, Gaithersburg, both of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/058,193

(22) Filed: Apr. 10, 1998

(51) Int. Cl.[7] ..... F42B 33/00
(52) U.S. Cl. ..... 86/50; 206/3; 220/88.1; 220/845
(58) Field of Search ..... 86/49, 50; 206/3; 220/88.1, 62.22, 323, 845, 848

(56) References Cited

U.S. PATENT DOCUMENTS

| | | | | |
|---|---|---|---|---|
| H314 | | 8/1987 | Betts . | |
| 3,391,823 | * | 7/1968 | Tijms | 220/62.22 |
| 3,648,614 | | 3/1972 | Berthmann et al. . | |
| 3,650,431 | | 3/1972 | Stewart . | |
| 3,739,731 | | 6/1973 | Tabor . | |
| 3,786,956 | | 1/1974 | Tabor . | |
| 3,822,807 | | 7/1974 | MacDonald et al. . | |
| 4,027,601 | | 6/1977 | Hickerson . | |
| 4,055,247 | | 10/1977 | Benedick et al. . | |
| 4,126,092 | | 11/1978 | Cross . | |

(List continued on next page.)

OTHER PUBLICATIONS

<http://www.nabcoinc.com/>, "NABCO Home Page," 2 pp; Feb. 12, 1998.
<http://www.nabcoinc.com/nabcprod. html>, 2 pp; Feb. 12, 1998.
<http://www.nabcoinc.com/nabcopti.html>, 2 pp; Feb. 12, 1998.
<http://www.nabcoinc.com/nabcspec.html>, 2 pp; Feb. 12, 1998.
<http://www.nabcoinc.com/nabcspec.html#ATHT>, 2 pp; Feb. 12, 1998.
<http://www.nabcoinc.com/nabcspec.html#MTCV>, 2 pp; Feb. 12, 1998.
<http://www.nabcoinc.com/nabcspec.html#ETCV>, 2 pp; Feb. 12, 1998.
<http://www.nabcoinc.com/nabccust.html>, 2 pp; Feb. 12, 1998.
<http://www.nabcoinc.com/nabcinfo.html>, 1 p. Feb. 12, 1998.

*Primary Examiner*—Harold J. Tudor
(74) *Attorney, Agent, or Firm*—Howard Kaiser

(57) ABSTRACT

The inventive device includes a box-shaped steel shell and rigid polyurethane foam which partially occupies the shell's interior so as to leave a compartment to be used for situation of a suspected explosive object. The compartment is accessed by a doored entrance which is provided in the shell. Some inventive embodiments include a polyethylene liner for foam wear protection, and/or a high-strength layer for attenuating explosive fragmentation. Foam bodies are carefully packed inside the compartment for separating the suspected explosive device from the doored entrance and for stabilizing the suspected explosive object during transit. Upon detonation, the foam pulverizes and the shell inelastically deforms into an ovaloid or cylindroid shape. The shell's edges and corners are convexly contoured for thwarting localized strain concentrations in the shell. The inventive device is implemented for a single explosive event, as distinguished from conventional explosive containment devices which are implemented on a repetitive basis. As compared with conventional devices, typical inventive embodiments are small, lightweight, portable and inexpensive; yet, unlike conventional devices, the invention's doored entrance and compartment are dimensioned to accommodate a large suspect package in its entirety, thereby obviating disassembly of the package.

26 Claims, 16 Drawing Sheets

U.S. PATENT DOCUMENTS

| | | | | |
|---|---|---|---|---|
| 4,432,285 | | 2/1984 | Boyars et al. . | |
| 4,437,382 | | 3/1984 | Yerushalmi . | |
| 4,454,798 | | 6/1984 | Shea et al. . | |
| 4,519,519 | * | 5/1985 | Meuschke et al. | 220/323 |
| 4,543,872 | | 10/1985 | Graham et al. . | |
| 4,566,588 | | 1/1986 | Kataczynski . | |
| 4,589,341 | | 5/1986 | Clark et al. . | |
| 4,768,418 | | 9/1988 | Blommer . | |
| 4,889,258 | | 12/1989 | Yerushalmi . | |
| 4,989,493 | | 2/1991 | Blommer et al. . | |
| 5,147,830 | | 9/1992 | Banerjee et al. . | |
| 5,157,223 | | 10/1992 | Wheeler et al. . | |
| 5,157,225 | | 10/1992 | Adams et al. . | |
| 5,267,665 | | 12/1993 | Sanai et al. . | |
| 5,348,178 | | 9/1994 | McLain . | |
| 5,394,786 | | 3/1995 | Gettle et al. . | |
| 5,613,453 | | 3/1997 | Donovan . | |
| 5,645,184 | | 7/1997 | Rowse et al. . | |
| 5,654,053 | | 8/1997 | Crane et al. . | |
| 5,668,342 | | 9/1997 | Discher . | |
| 6,019,237 | * | 2/2000 | Durham et al. | 220/88.1 |
| 6,112,931 | * | 9/2000 | Booth et al. | 220/88.1 |

* cited by examiner

EXPLOSIVE CONTAINMENT DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to methods and apparatuses for explosion containment, more particularly with regard to structures which are intended to enclose an explosive device and to some degree contain the explosive effects resulting from detonation of the explosive device.

Explosives kill, maim and destroy. Ever threatening are the perils of violent acts and militant activities against society. Much to the dismay of civilized society, there exists the ongoing need to protect people and property from terroristic acts which implement explosive devices. Terrorist bombs represent a constant threat in public areas, especially on commercial aircraft. In addition, the need arises in military conflicts to protect against damage and injury caused by one's own armaments due to hostile fire.

Law enforcement officials and responsible governing bodies are forced to effect physical security measures which limit exposure of the general populace to terrorist actions. Various forms of security-screening are commonly effectuated at entrances to major public buildings. Many airlines are expanding the scope of luggage-screening; prior to loading into the aircraft cargo hold, stowed baggage is checked for the presence of explosive devices.

When detection methods identify a package containing an explosive device, some appropriate action must be taken to prevent damage or injury due to activation of the device. Generally, two options exist, viz., (i) safe isolation of the suspect device within a bomb containment vessel, or (ii) evacuation of the endangered building.

Commercially available bomb disposal vessels are typically designed as robust elastic pressure vessels which are capable of withstanding repetitive loading by bomb detonations. To permit repetitive loading, these conventional appliances are of robust and imposing construction. By their very nature, such commercially available devices are large and heavy, and construction thereof is costly and labor intensive.

Commercially available bomb containment vessels are normally too expensive for dedicted installation at a particular site. Many jurisdictions are especially loath to pay these prohibitive costs in view of the relative infrequency of "bomb scare" episodes.

Moreover, size and weight characteristics impede conveyence of commercially available containment vessels from a remote location to the vicinity of a package bomb. Many buildings entrances, decks and freight elevators cannot accommodate or support such large and heavy equipment.

Furthermore, the access port for a commercially available containment device is typically of such small dimension as to undesirably constrain the maximum size of the explosive device which can be admitted therethrough.

The aforementioned deficiencies of commercially available containment devices tend to significantly increase exposure and handling of a suspect explosive device before safe isolation thereof can be established. Evacuation of an entire facility, pending arrival of a transportable bomb containment vessel, is often the only viable option.

SUMMARY OF THE INVENTION

In view of the foregoing, it is an object of the present invention to provide apparatus which can enclose an explosive device and which can effectively contain an explosion originating within said apparatus.

It is a further object of this invention to provide such explosive containment apparatus which is structurally configured so as to permit entry therein and enclosure thereby of a large object which includes an explosive device.

Another object of this invention is to provide such explosive containment apparatus which is less bulky and more lightweight than conventional apparatus used for explosive containment.

A further object of the present invention is to provide such explosive containment apparatus which is more economical than conventional apparatus used for explosive containment.

In accordance with many embodiments of the present invention, apparatus for explosive containment includes an outer metallic (e.g., metal or metallic composite) shell or non-metallic composite shell (e.g. kevlar-resin composite) and an inner rigid foam portion. The inventive apparatus has an interior space which is at least partially surrounded by the inner rigid foam portion. The outer metallic shell is substantially box-shaped and includes six approximately rectangular faces. The inventive apparatus preferably includes closure means (e.g., including a door) which permits access to the interior space. Many inventive embodiments include a plastic portion which at least partially lines the inner rigid foam portion.

For many inventive embodiments, the outer metallic shell has contoured edges and vertices. The outer metallic shell includes six approximately rectangular faces, twelve curved junctional edges and eight curved junctional vertices. Each curved junctional edge adjoins two adjacent approximately rectangular faces. Each curved junctional vertex adjoins three curved junctional edges.

This invention represents an affordable physical security appliance for protection of personnel and equipment from the damaging effects of a package bomb explosion. The inventive device is essentially a lightweight, plastically responding pressure vessel designed to withstand a singular loading at its full-rated capacity. In other words, unlike conventional explosive containment devices which contemplate repeated usage, the inventive device is intended for blast loading once at or approaching its full-rated design capacity.

The inventive explosive containment device is substantially lighter and significantly less expensive (perhaps four to eight times less expensive) than are conventional explosive containment devices. By confining the effects of an unintended explosive activation, the inventive bomb containment vessel enables law enforcement officials to safely transport a suspected bomb without incurring the costs associated with repetitive use fixtures. Inventive inclusion of a fragmentation layer extends inventive application so as to encompass fragmenting munitions such as pipe bombs, mortars and grenades.

The inventive explosive containment device functions essentially as a singular-use, plastically responding pressure vessel. The controlled inelastic response of the main inventive structure is the inventive feature which especially promotes significant reductions in size, weight and cost.

The inventive explosion containment device decreases the total energy output of an explosive device by eliminating excess atmospheric oxygen from the device interior. Shock attenuation and heat transfer to the pulverized foam further diminish the degree of loading which reaches the invention's structural metallic shell.

The inventive pressure vessel shell dissipates much of the mechanical work of the confined gasses through inelastic deformation (stretching plastically). Inelastic deformation changes kinetic energy (structural shell movement) into thermal energy (increased temperature of the shell metal, e.g., steel). Conversely, elastic deformation only converts kinetic energy into stored mechanical potential energy. With a low modulus elastic structural shell, this stored energy (analogous to a stretched spring) remains available to do additional work during elastic rebound.

Since the invention's pressure vessel shell is not an elastic structure, there is no need to worry about safely relieving the significant potential energy stored in the elastically deformed shell. There is no need to ensure that elastic rebound occurs safely.

The confined gasses within the invention's pressure vessel are of a lower pressure and a lower temperature than occurs in relation with conventional explosive containment vessels. If a failure of the inventive pressure vessel were to happen, the remaining mechanical energy would be considerably smaller and thus potentially less destructive of the surroundings.

The reduced cost of the present invention allows purchase of a single inventive explosive containment unit at a fraction of the price of a single conventional explosive containment unit, or the purchase of several inventive explosive containment units at the price of a single conventional explosive containment unit. Purchase of several inventive units permits deployment or staging at strategic locations within a jurisdiction, thereby reducing the response time of a bomb squad; in addition, such a strategy would allow more efficient reaction to multiple simultaneous bomb threats.

The rectangular box-like shape of the inventive device is space-efficient because it permits passage of large objects through a doorway which can approach coextensiveness with a rectangular side of the inventive device. The inventive large door permits placement of the entire suspect explosive package into the inventive containment vessel; this obviates the need, associated with conventional containment vessels, to remove the explosive device from its package prior to placing the explosive device in the containment vessel. Furthermore, according to many inventive embodiments, the door is operable, by either a human or a robot, without power assist; this advantageously eliminates another possibility of malfunction and reduces operational time.

At the same time, the inventive explosive containment device is efficiently sized. The inventive device is small enough to fit through a typical doorway, thereby allowing transportation of the inventive device to the bomb; this obviates the need, associated with conventional containment vessels, to transport the bomb to the containment vessel via a bomb retrieval robot.

Furthermore, as part of the large inelastic response of the inventive device upon explosion originating therein, the outer metal shell deforms into a rudimentary form of a cylindrical or cylindroid or ovaloid pressure vessel. This inelastic deformation permits the inventive device to have the greater space efficiency of a rectangular prism, but with the greater pressure vessel efficiency akin to that of a cylinder.

Moreover, this invention's singular use "philosophy" is compatible with the tactical doctrines of most police bomb squads. Bomb squad technicians generally do not intentionally detonate an explosive device in their repetitive-use bomb containment vessel, since this would quickly expend at least some of the useful life of the expensive vessel. Rather, after safely transporting the suspect explosive device to a remote location, bomb squad technicians remove it from the bomb containment vessel and then attempt to disrupt or deactivate it mechanically. The bomb containment vessel undergoes loading only in the event of an unintentional activation of the explosive device; hence, the bomb squad's standard operating procedure largely negates the requirement for a bomb containment fixture which is capable of repetitive loading.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
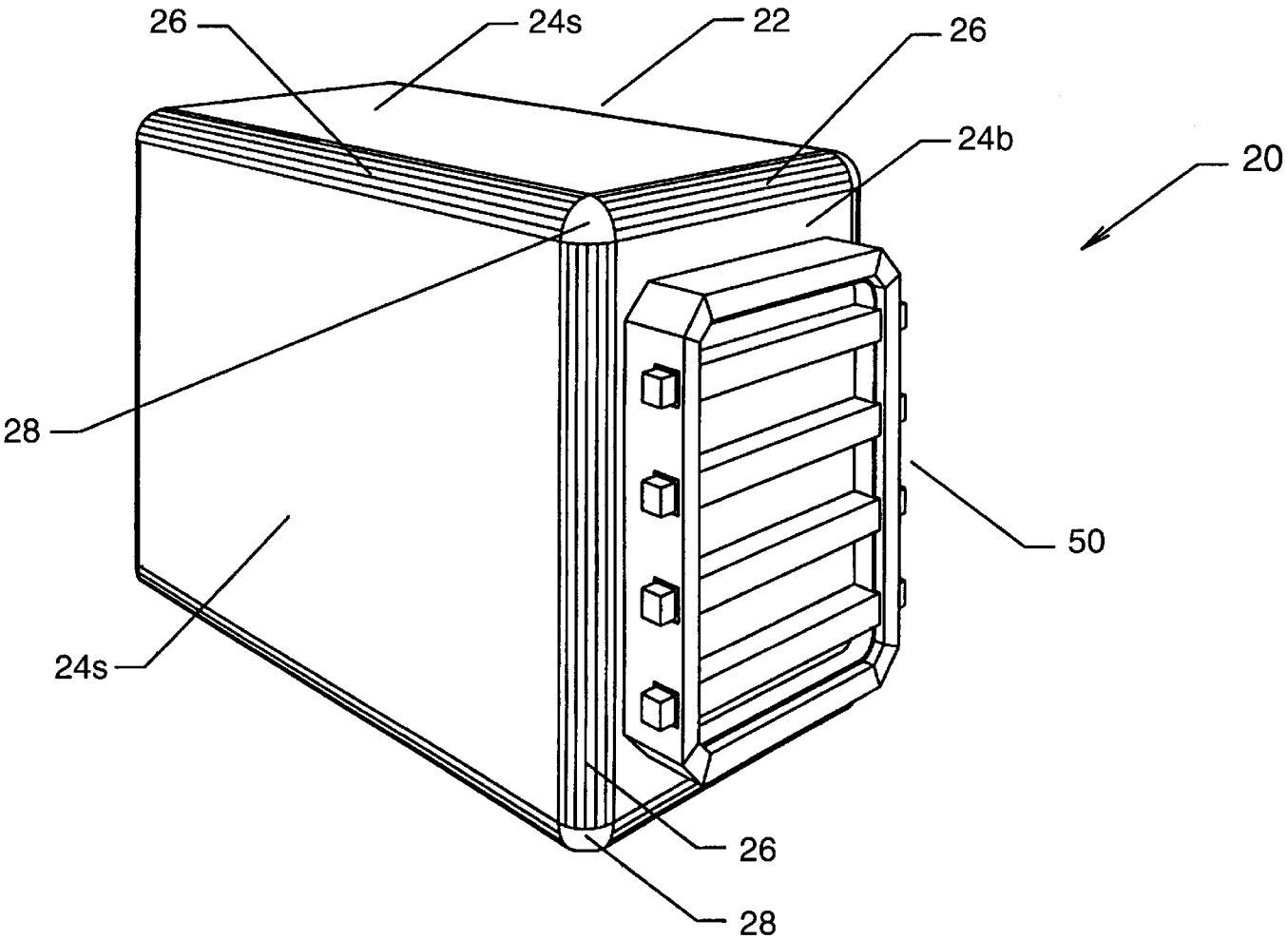
FIG. 1 is a diagrammatic perspective view of an embodiment of an inventive explosive containment device.
Figure 2:
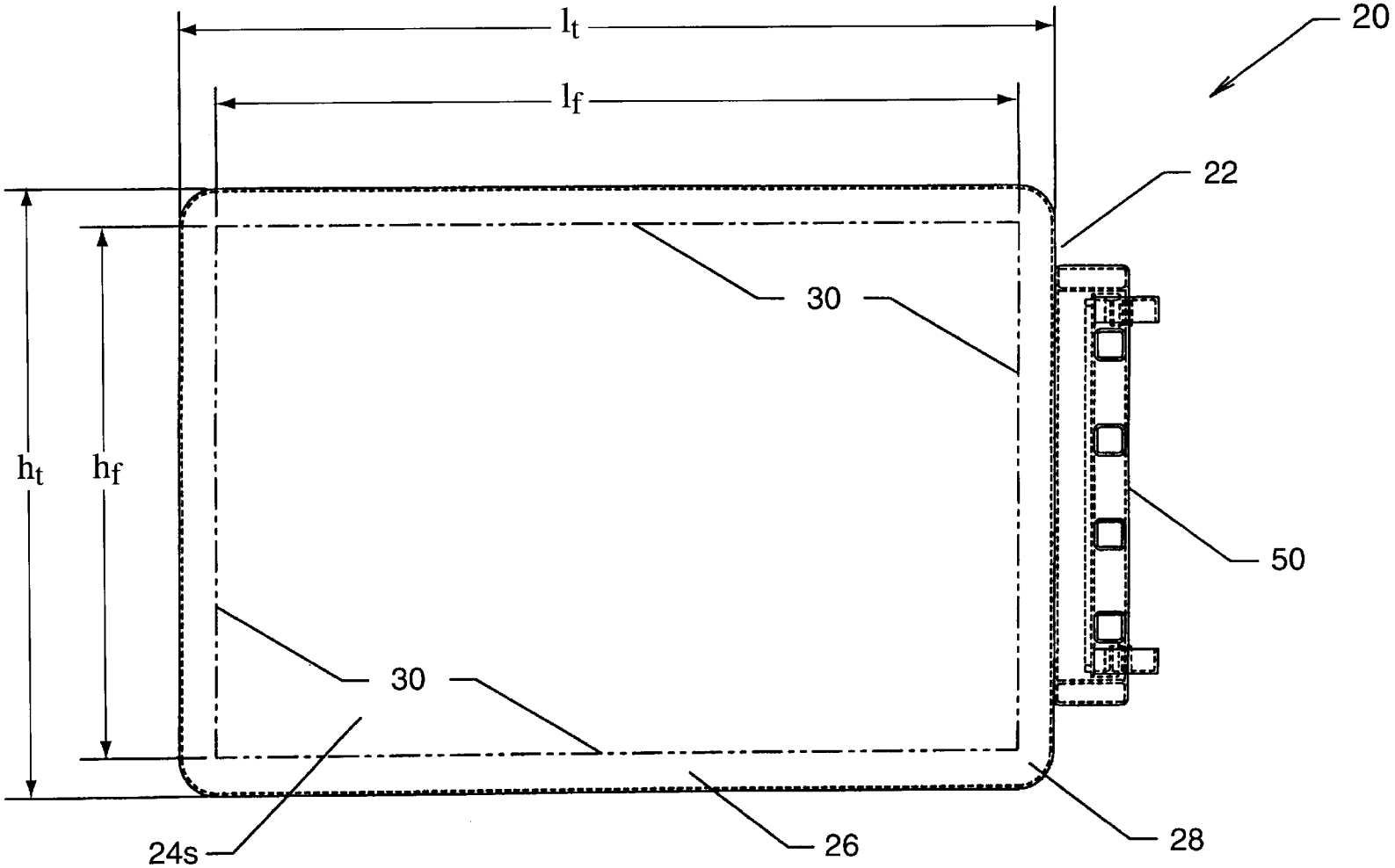
FIG. 2 is a diagrammatic side elevation view of the inventive embodiment shown in FIG. 1.
Figure 3:
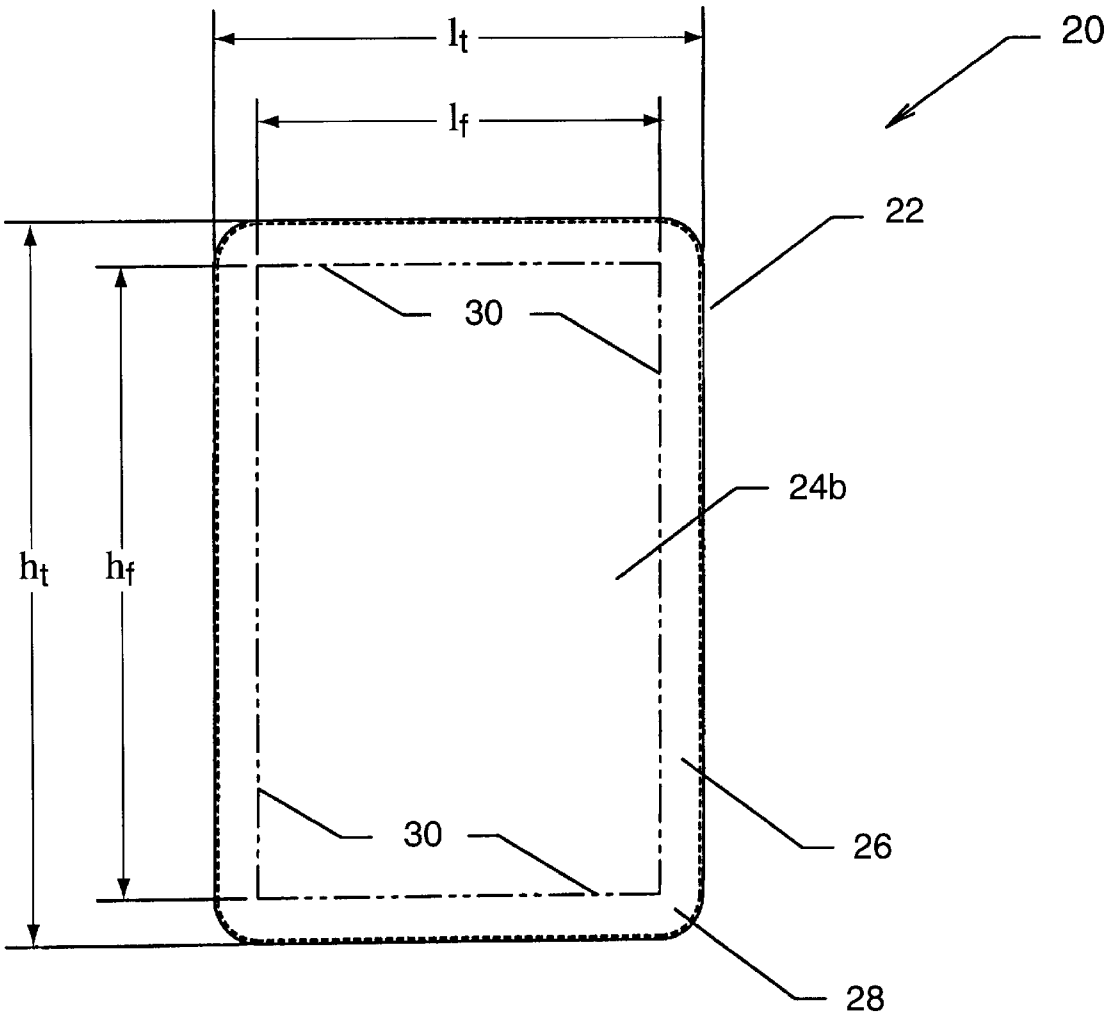
FIG. 3 is a diagrammatic end (end opposite closure assembly end) elevation view of the inventive embodiment shown in FIG. 1.
Figure 4:
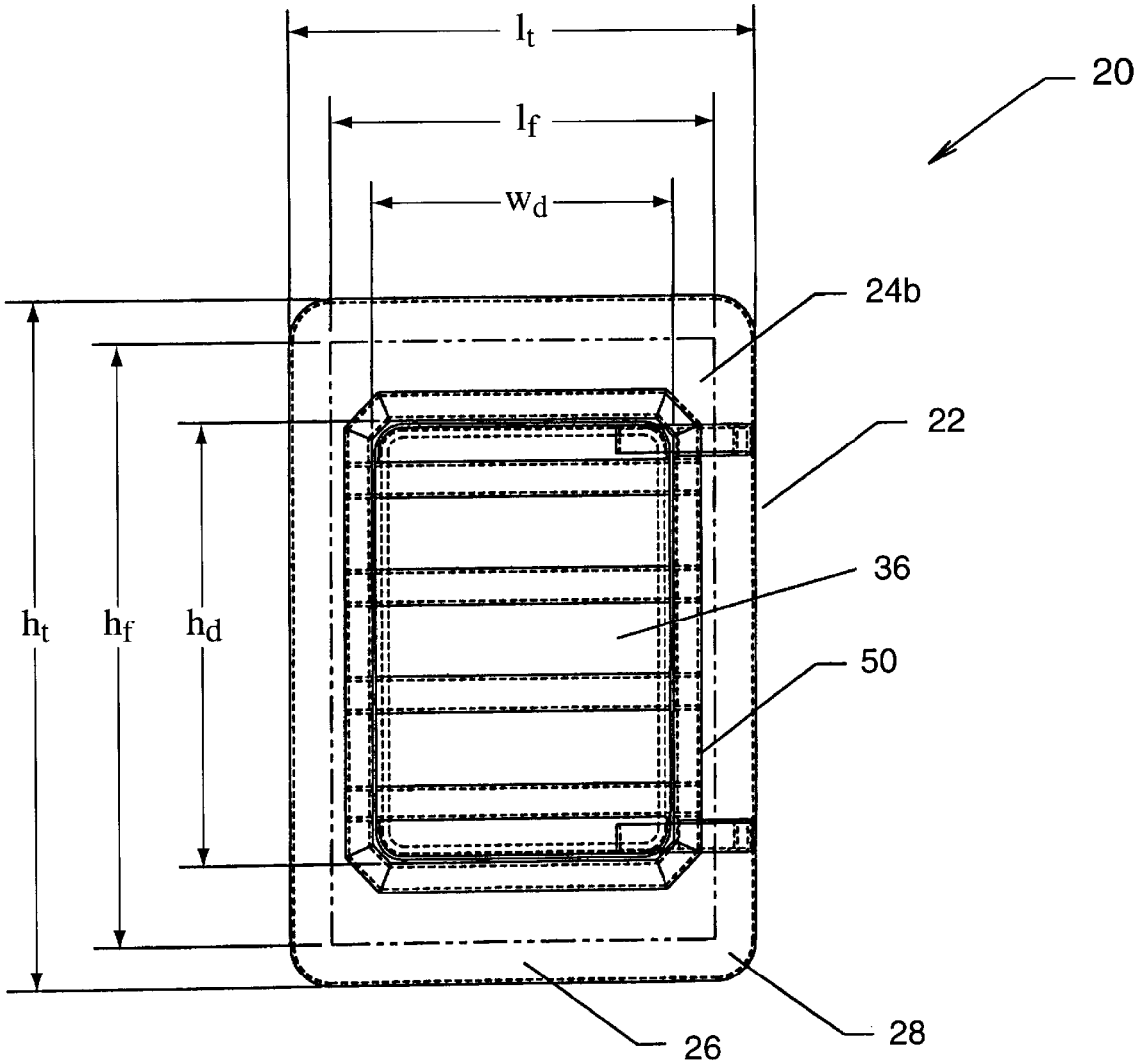
FIG. 4 is a diagrammatic end (closure assembly end) elevation view of the inventive embodiment shown in FIG. 1.
Figure 5:
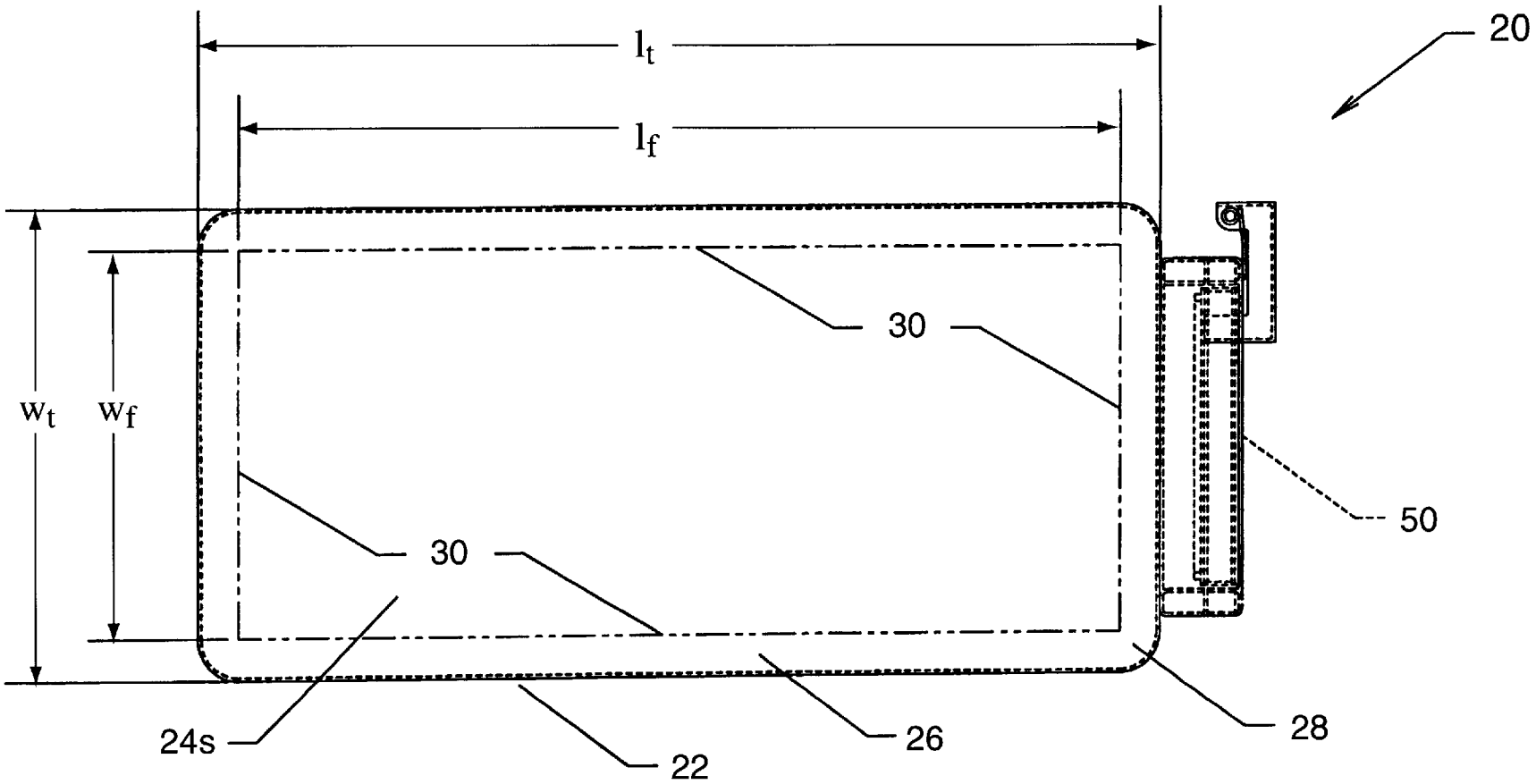
FIG. 5 is a diagrammatic top plan view of the inventive embodiment shown in FIG. 1.
Figure 6:
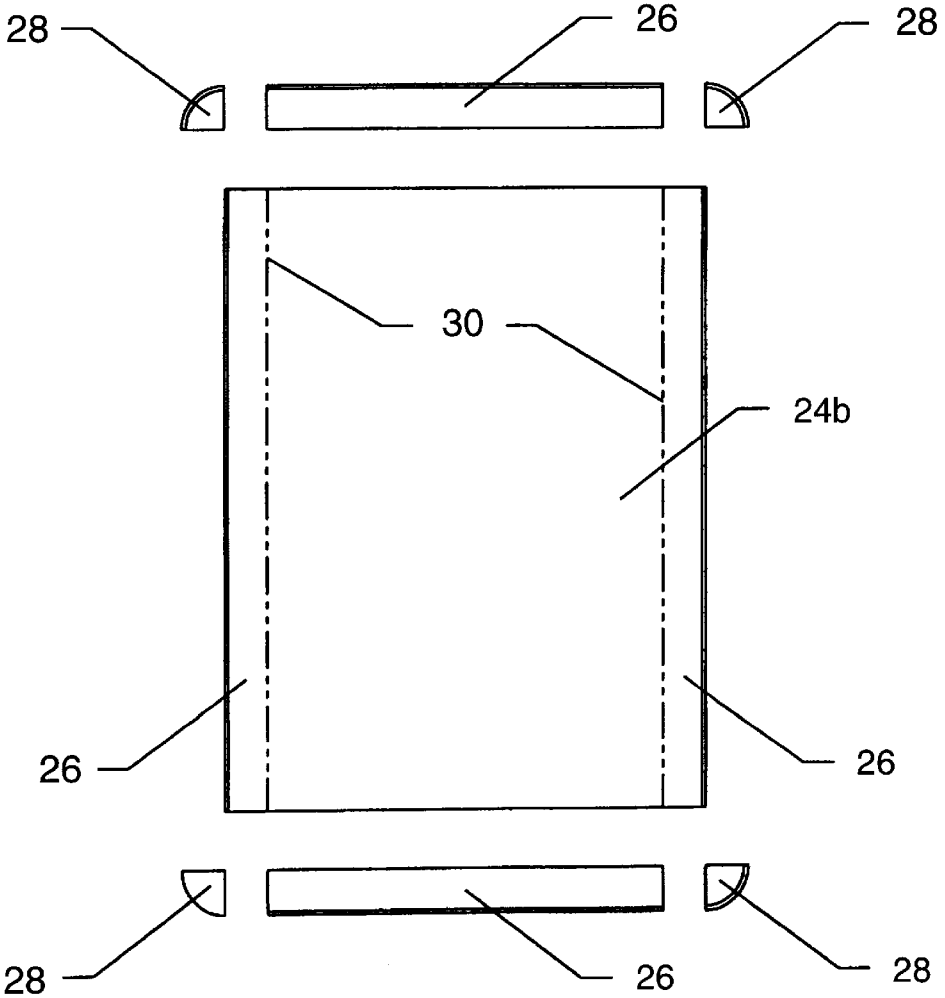
FIG. 6 is a diagrammatic exploded end elevation view, illustrating faces, edges and corners, of the inventive embodiment shown in FIG. 1.

The U.S. Navy's Naval Surface Warfare Center, Carderock Division, recently developed a prototype of an inventive explosive containment device. On Apr. 14, 1997 the U.S. Navy, in cooperation with the Federal Aviation Administration (FAA), deployed an inventive prototype to Hartsfield Airport in Atlanta, Georgia for utilization by Delta Airlines on an experimental basis. Inventive explosive containment device 20, variously shown in most of the drawing figures herein having an outer shell characterized by a substantially parallelepipedal shape, is representative of this inventive prototype which is being tested in Atlanta. Up to forty additional explosive containment units are planned for fabrication by the U.S. Navy (with cooperation by the U.S. Army at Aberdeen, Maryland) for the FAA for deployment to major international airports in the United States.

Referring now to FIG. 1 through FIG. 6, explosive containment device 20 includes thin, high-strength, steel shell 22. To a substantial degree, the shape of shell 22 is rectangular parallelepipedal. The shape of shell 22 is characterized by six approximately planar approximately parallelogrammic approximately rectangular faces 24*s* and 24*b*, twelve curvilinear edges (edge portions) 26 and eight semi-spherical vertices (vertex portions or corners) 28.

The four approximately rectangular faces 24*s*, which are longitudinal with respect to shell 22, are approximately congruent. The two approximately rectangular faces 24*b*, which are at the ends of shell 22, are approximately congruent. Shell 22 deviates from a perfect rectangular parallelepipedal shape most notably in that edges 26 and vertices 28 are curvilinear rather than rectilinear.

In accordance with the principles of the present invention, shell 22 can have any of a variety of polyhedral shapes. Preferably, however, the polyhedral shape of shell 22 is a prism, a geometric shape which peculiarly manifests a kind of symmetry and regularity which advances the invention's effectiveness in terms of operation and blast loading containment.

A prism is a polyhedron which has two parallel, congruent polygons as base faces and at least three parallelograms as side faces. The base faces can be triangular (three-sided); quadrilateral (four-sided); pentagonal (five-sided); hexagonal (six-sided); septilateral (seven-sided); octagonal (eight-sided); nonagonal (nine-sided); etc. The number of sides of the polygonal base face equals the number of side faces.

An inventive explosive containment device which exhibits a prismatic character comprises a metallic housing and a rigid foam filling, wherein: the rigid foam filling provides a cavity; the metallic housing includes door means communicating with the cavity; the metallic housing approximately defines a prism having two base faces, at least three side faces, at least six vertices and at least nine edges; the number of vertices is twice the number of side faces; the number of edges is three times the number of side faces; one base face provides the door means; the vertices are approximately semi-spherically (semi-globularly) contoured; and the edges are approximately curvilinearly (arcuately) contoured.

Figure 18:
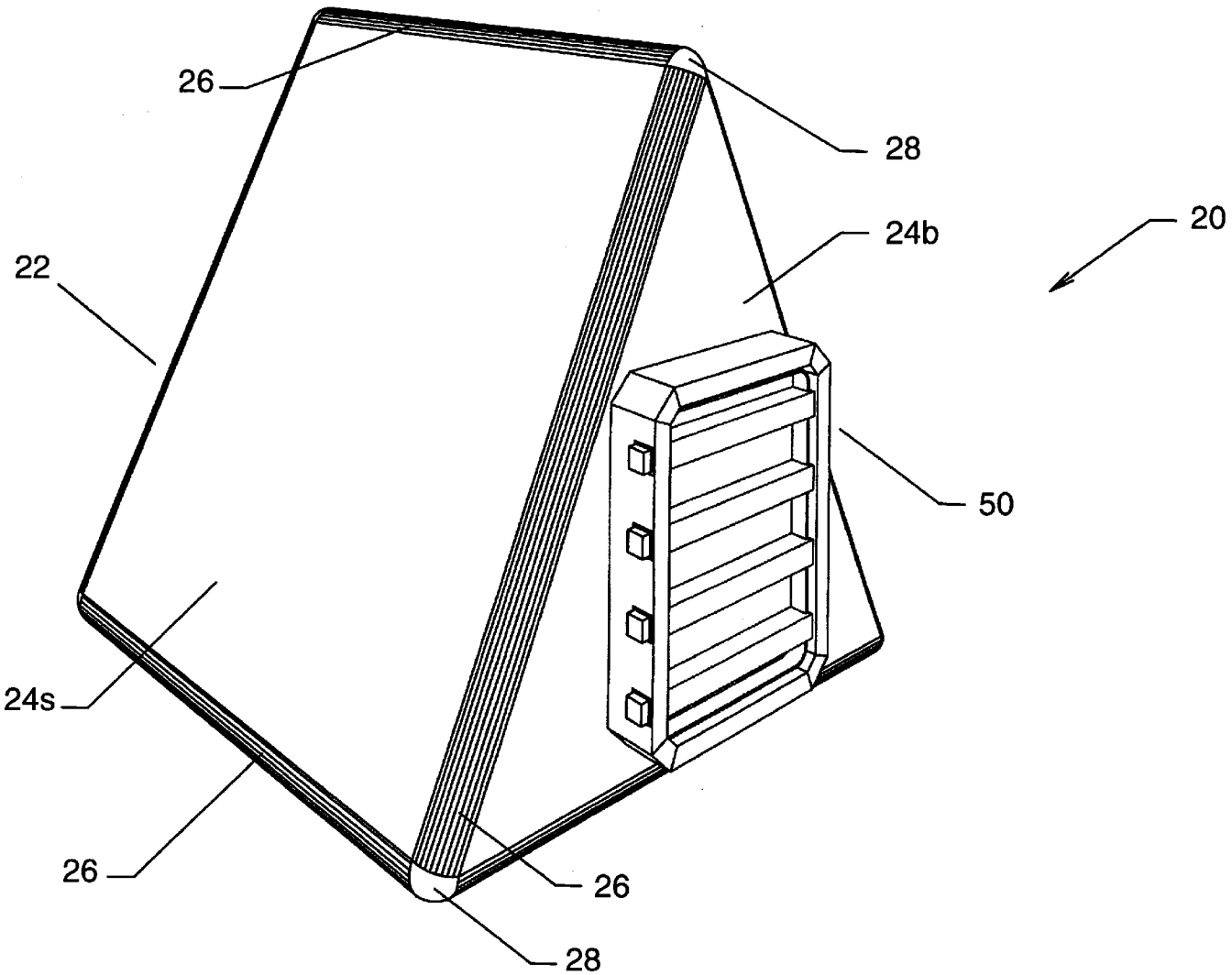
FIG. 18 is a diagrammatic perspective view of another embodiment of an inventive explosive containment device, this embodiment having an outer shell characterized by a triangular-base prism shape.

With reference to FIG. 18, prismatic shell 22 of inventive device 20 has two triangular base faces 24*b*, three rectangular side faces 24*s*, nine curvilinear edges 26 and six semi-spherical vertices 28.

A parallelepiped, which has six parallelogrammic faces, can be considered to be a prismatic category having two parallelogrammic base faces and four parallelogrammic side faces. Shell 22 shown in most of the figures herein is a six-sided (six-faced) prism. Prismatic shell 22, a parallelepiped which is rectangular, has the two rectangular faces 24*b* as the base faces and the four rectangular faces 24*s* as the side faces.

As the number of polygonal sides of the inventive prismatic shell's base face (which equals the number of its side faces) increases, the shell's shape approaches that of a cylinder; hence, in inventive practice, any increase beyond six in the number of the prismatic shell's faces will tend to be conducive to post-blast ovaloid/cylindroid shell deformation, but counterproductive to the pre-blast spatial benefits afforded by a six-faced prismatic shell (i.e., having two quadrilateral base faces and four side faces).

Figure 7:
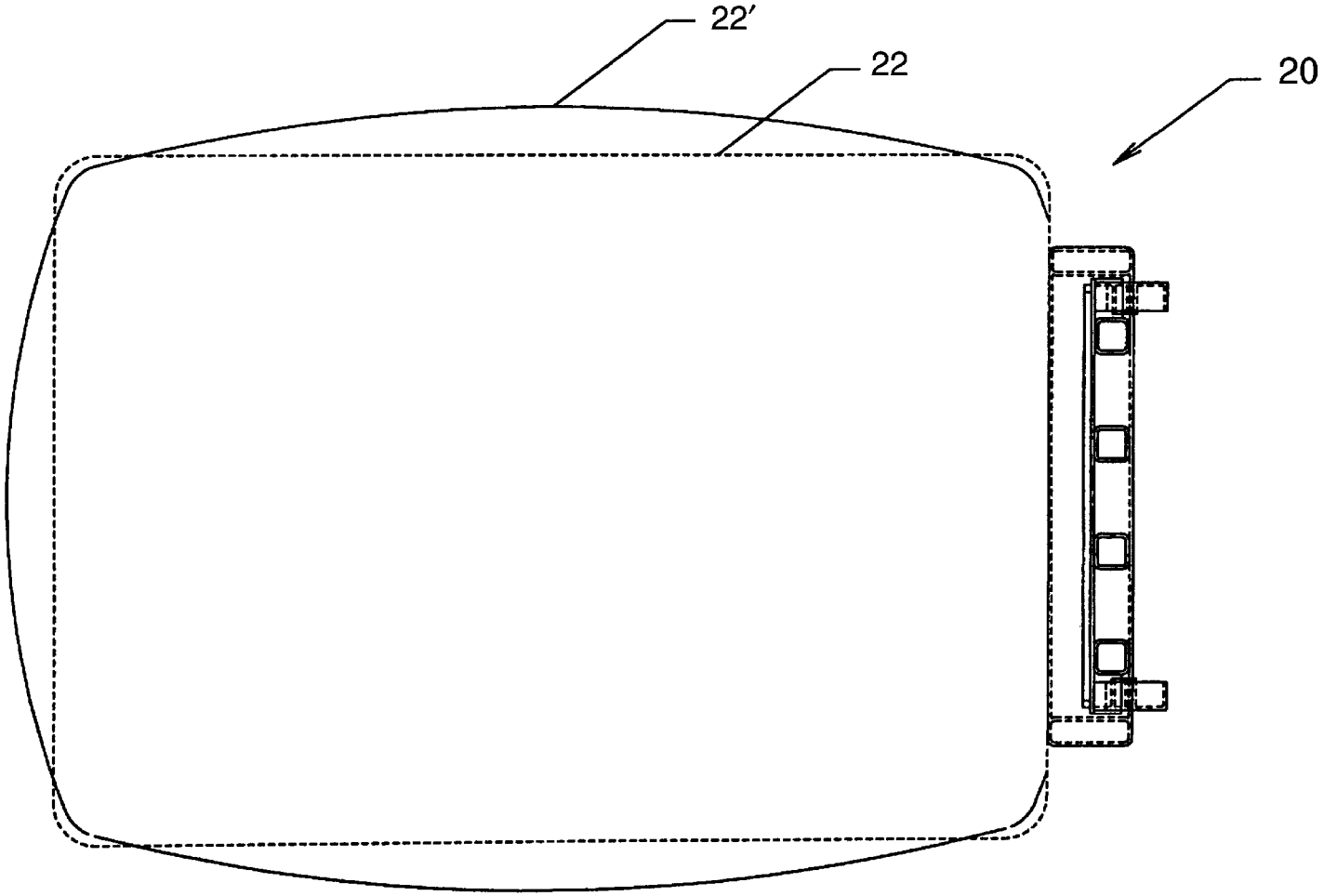
FIG. 7 is a diagrammatic side elevation view, similar to the view shown in FIG. 2, of the inventive embodiment shown in FIG. 1, wherein the inventive shell structure has inelastically deformed.
Figure 8:
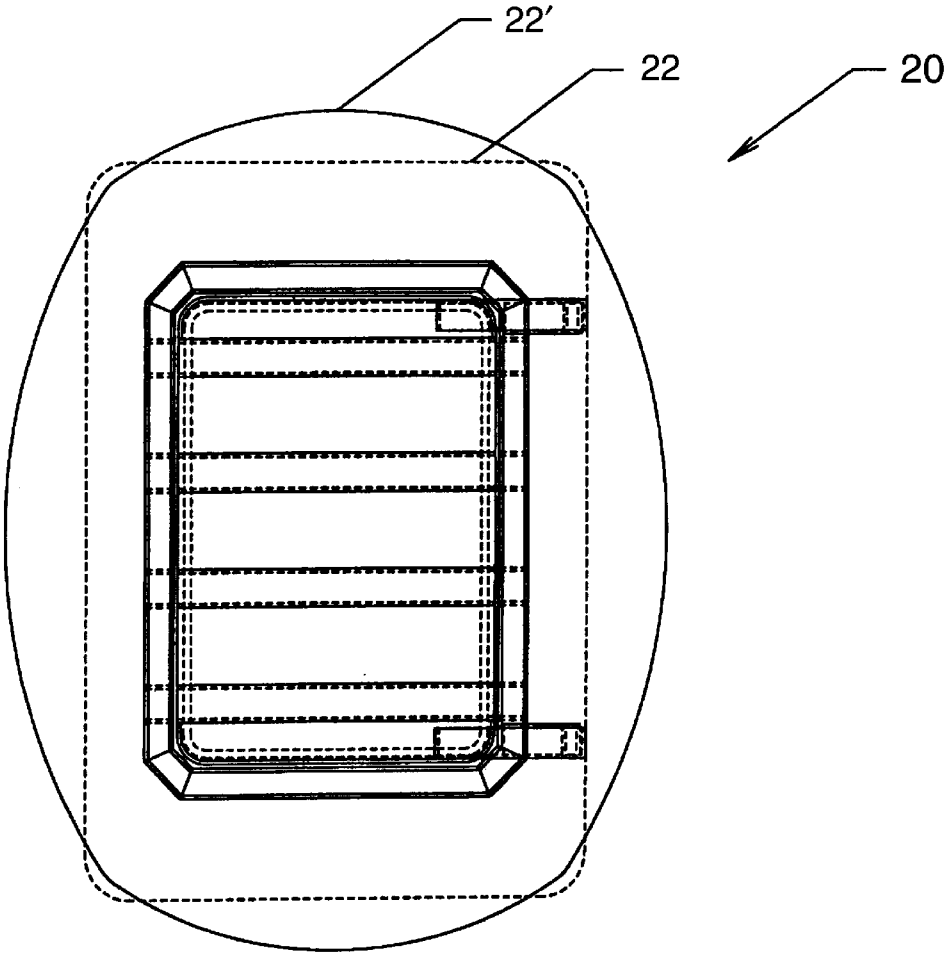
FIG. 8 is a diagrammatic end (closure assembly end) elevation view, similar to the view shown in FIG. 4, of the inventive embodiment shown in FIG. 1, wherein the inventive shell structure has inelastically deformed as shown in FIG. 7
Figure 9:
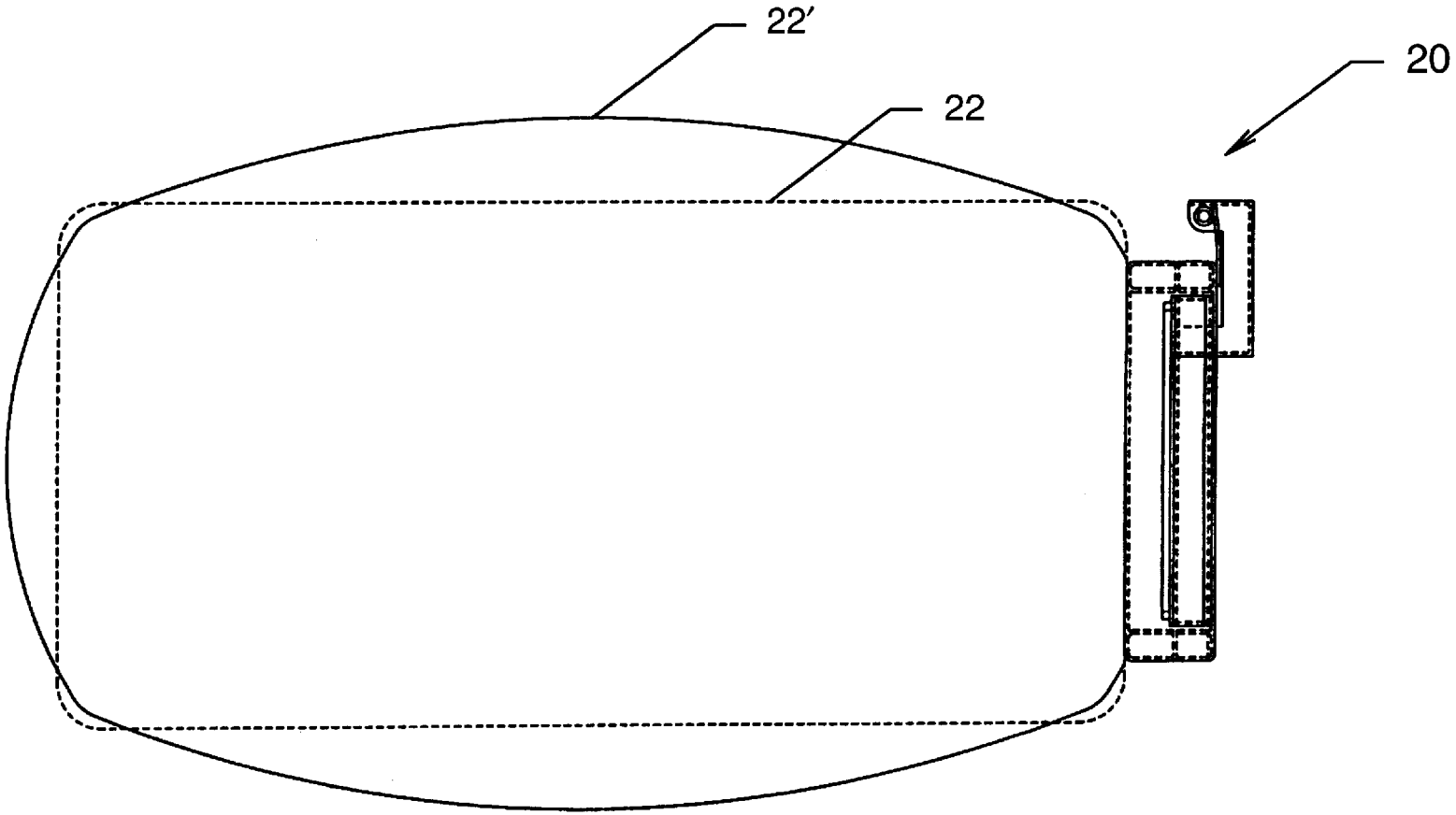
FIG. 9 is a diagrammatic top plan view, similar to the view shown in FIG. 5, of the inventive embodiment shown in FIG. 1, wherein the inventive shell structure has inelastically deformed as shown in FIG. 7

With reference to FIG. 7 through FIG. 9, satisfactory performance of inventive explosion containment device 20 is dependent upon the ability of rectangular prismatic shell 22 to expand under blast loads into inelastically deformed shell 22' having a shape which is a rudimentary rendition of a cylindroid (e.g., circular or elliptical cylinder) or an ovaloid (e.g., ellipsoid) or some sort of combination thereof. Generally with regard to inventive practice, this ability is promoted by the original (pre-blast) prismatic shape of shell 22, regardless of the number of side faces thereof; this ability is especially fostered if the geometric shape of shell 22 is symmetrical about an imaginary axis which passes through the two congruent parallel base faces—that is, if the two base faces of the prism are each symmetrical about an imaginary central point.

It is noted that the inelastic deformation of shell 22 (so as to become shell 22') is considerably less extensive at closure assembly 50 end 24*b* than such inelastic deformation is elsewhere in shell 22.

The inhibition of shell rupture during deformation into a quasi-ovaloid or quasi-cylindroid requires the achievement of reasonably uniform straining of steel shell 22. Shell 22 is fabricated from carefully selected materials (such as steel) that offer high strength, ductility and toughness. Fabrication of shell 22 from steel which offers these qualities assures that high plastic strain of shell 22 can occur safely and reliably under blast loading.

Referring again to FIG. 1 through FIG. 6 and particularly to FIG. 6, the prevention of highly localized strain during either fabrication or blast loading of inventive device 20 is essential to its performance. The twelve edge portions 26 each provide a radial transition (transitional radius) along the junction between two contiguous face portions 24*s* and/or 24*b*. Similarly, the eight vertex portions 28 each provide a spherical transition (spherical cap) at the junction of three converging edge portions 26.

Tangent lines 30 shown in FIG. 2 through FIG. 5 represent the boundaries between edges 26 and faces 24*s* or 24*b*. The radial and spherical transitions prevent highly localized straining of the steel; that is, these transitions prevent strain concentrations that locally limit the remaining ductility of the steel and thus precipitate early rupture of steel shell 22.

True radial transitions, which tangentially and smoothly converge into each face 24*s* or 24*b*, are inventively necessary in order to prevent the high local strains that develop along discrete bends or creases. Metal-forming operations must therefore effectuate an appropriate methodology (such as a methodology employing a continuous radius punch and die) to properly form the radial transitions in the shell 22 plating. Machining of the spherical transitions from steel bar stock also furthers the goal of preventing localized strains. Proper material selection and forming ensure adequate plastic strain capacity under service loads.

The U.S. Navy's prototypical inventive device 20 weighs less than two thousand pounds and is capable of confining the blast and debris from an explosion (e.g., by a package bomb) of up to the equivalent of five $Ib_m$ TNT. The U.S. Navy's inventive prototype includes a steel shell 22 which is about one-quarter inch (0.25 in) thick and which has the following approximate dimensions: total length $l_T$=72 inches; facial length $l_F$=66 inches; total width $W_T$=34 inches; facial width $W_F$=28 inches; total height $h_T$=48 inches; facial height $h_F$=42 inches; door width $W_D$=21.5 inches; door height $h_D$=30.5 inches. The total width $W_T$ of 34 inches is notable as permitting steel shell 22 to fit through a standard 36 inch door opening.

It is nevertheless pointed out that the aforesaid dimensions, which have been directed toward specific applicational requirements for the U.S. Navy's inventive prototype, should not be considered to represent general inventive optimization in either an absolute or relative sense. In other words, depending on the application, there is a diversity of dimensional sizes and shapes (more flat, more elongated, more cubical, etc.) which metallic shell 22 can preferably have in practicing the present invention.

Reference now being made to FIG. 10 through FIG. 12 and FIG. 17, steel shell 22 is partially filled with rigid polyurethane foam material 32. Central cavity 34 is a void or bore which is provided within foam 32 and which serves as a chamber or compartment. Cavity 34 is bordered upon by foam 32 except at closure assembly 50 end 24*b*, at which location cavity 34 is bounded by door 36 when door 36 is closed. Cavity 34 is used for receiving the suspected package bomb.

The terms "foam" and "foam material" as used herein refers to any two-phase gas-solid material system in which the solid has continuity. Foam material is "spongelike" in that it has a cellular structure. The cells of a foam material can be "closed" (unicell type), "open" (interconnecting-cell type) or a combination thereof.

For most embodiments and applications of the present invention, the solid of the foam material is preferably a synthetic polymer or rubber. There are many conventionally known foam materials in this category, such materials being variously and generally interchangeably described as "plastic foams," "foamed plastics," "cellular polymers" and "expanded plastics." Many inventive embodiments preferably utilize a polyurethane foam material. Varieties of other kinds and categories of foam materials, e.g., glass foams, ceramic foams and metal foams, are also conventionally known, and may be appropriately or preferably used for a given embodiment or application in practicing this invention.

Foam materials vary in terms of consistency. Foamed plastics generally range in density between about 0.1 pounds per square foot to about 65 pounds per square foot. Foam materials such as foam plastics generally range in firmness (i.e., in terms of greater rigidity versus greater flexibility) from rigid materials which are suitable for structural use to flexible materials which are suitable for use in soft cushions. Although inventive practice admits of utilization of either a rigid or flexible foam, the vast majority of inventive embodiments preferably utilize a rigid foam such as is conventionally known for various structural applications. In addition, for reasons explained hereinbelow involving pulverization of the foam, it is generally inventively preferable that the rigid foam have a frangible quality.

The ordinarily skilled artisan is acquainted with the various types of foam materials and their characteristics (e.g., thermal, mechanical and chemical properties), and is capable of selecting a foam material which may be appropriately or preferably used as the foam material in practicing any of the multifarious embodiments and applications of the present invention. See, e.g., Grayson, Martin, *Encyclopedia of Composite Materials and Components*, John Wiley & Sons, New York, 1983, "Foamed Plastics," pages 530–574; Brady, George S., Clauser, Henry *R., MaterialsHandbook, McGraw-Hill*, Inc., New York, 1991, pages 341–351 ("foam materials"), pages 718–719 ("sandwich materials").

Figure 10:
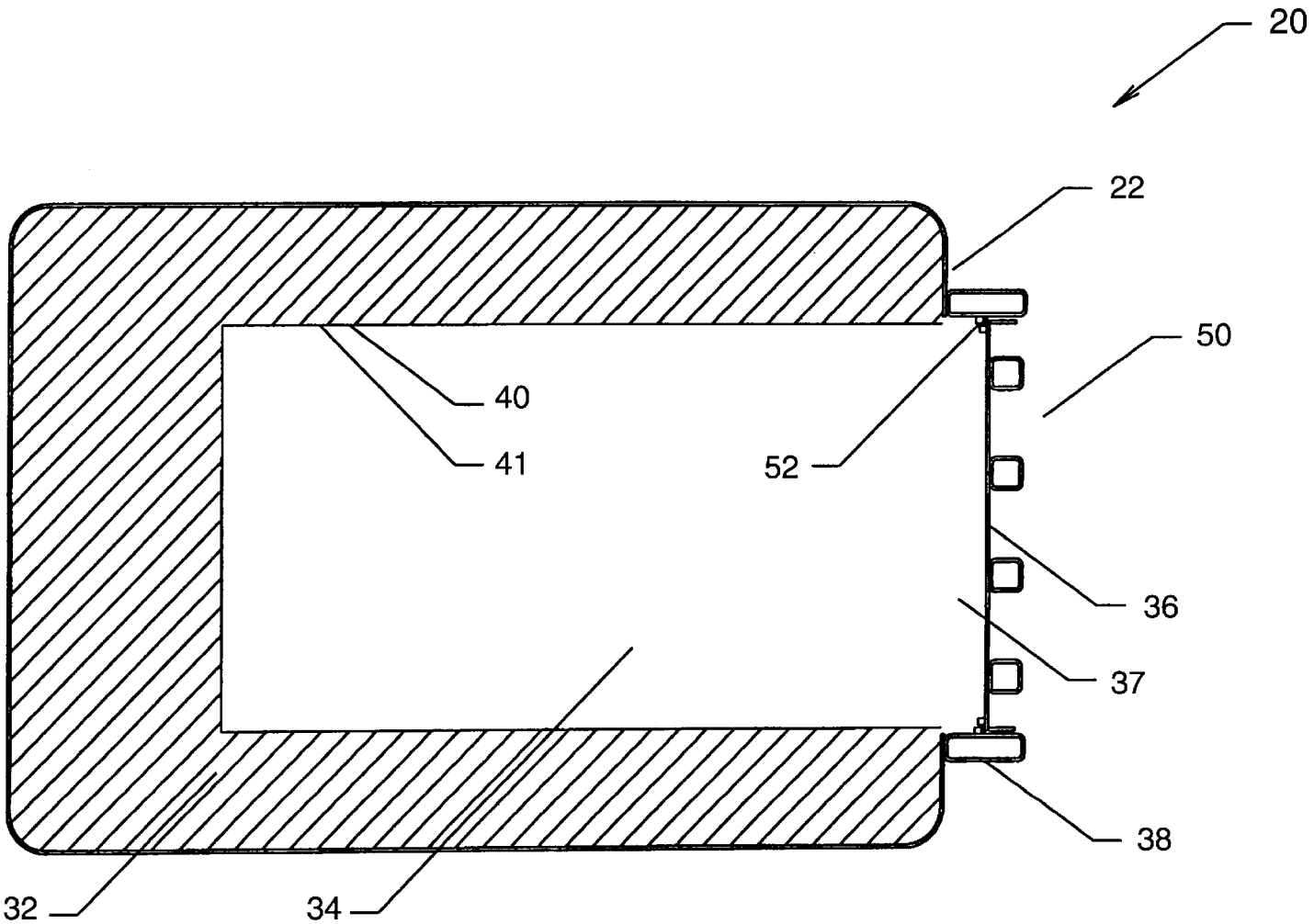
FIG. 10 is a diagrammatic cross-sectional side elevation view, similar to the view shown in FIG. 2, of the inventive embodiment shown in FIG. 1.
Figure 11:
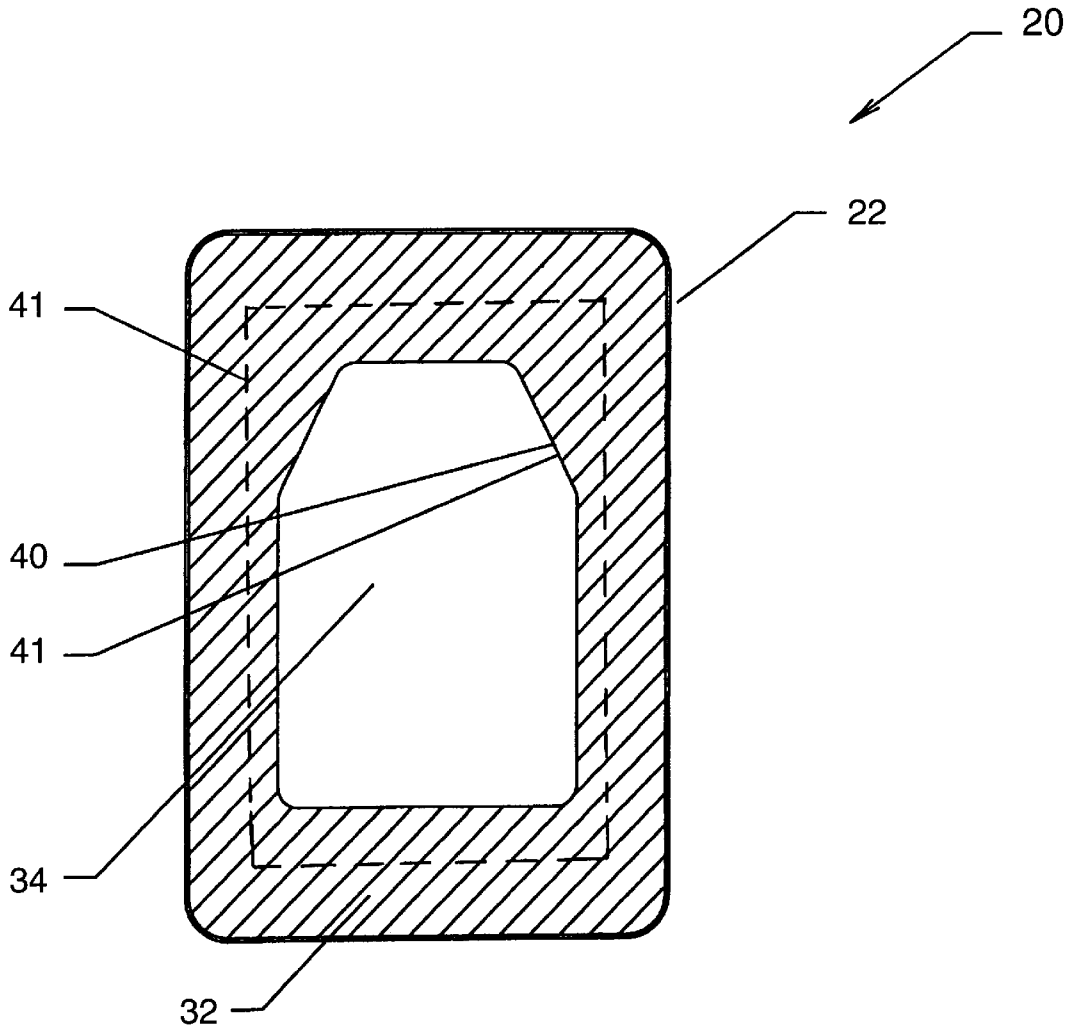
FIG. 11 is a diagrammatic cross-sectional end (closure assembly end) elevation view, similar to the view shown in FIG. 4, of the inventive embodiment shown in FIG. 1.
Figure 12:
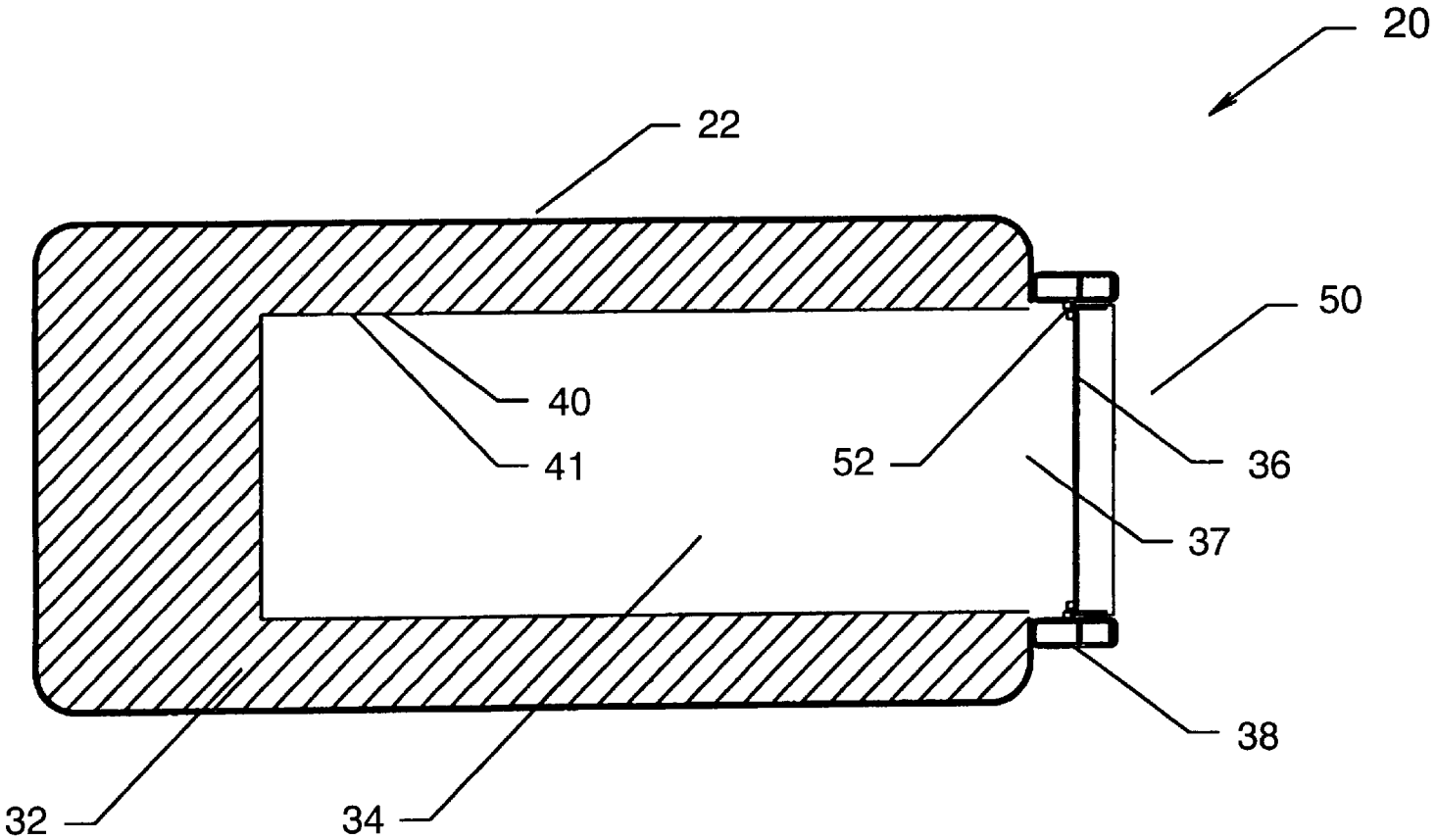
FIG. 12 is a diagrammatic cross-sectional top plan view, similar to the view shown in FIG. 5, of the inventive embodiment shown in FIG. 7.
Figure 14:
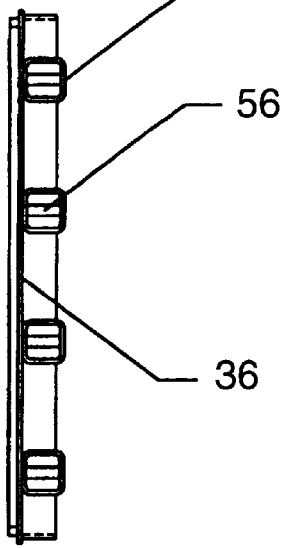
FIG. 14 is a diagrammatic edgewise elevation view of the door of the closure assembly shown in FIG. 13.
Figure 13:
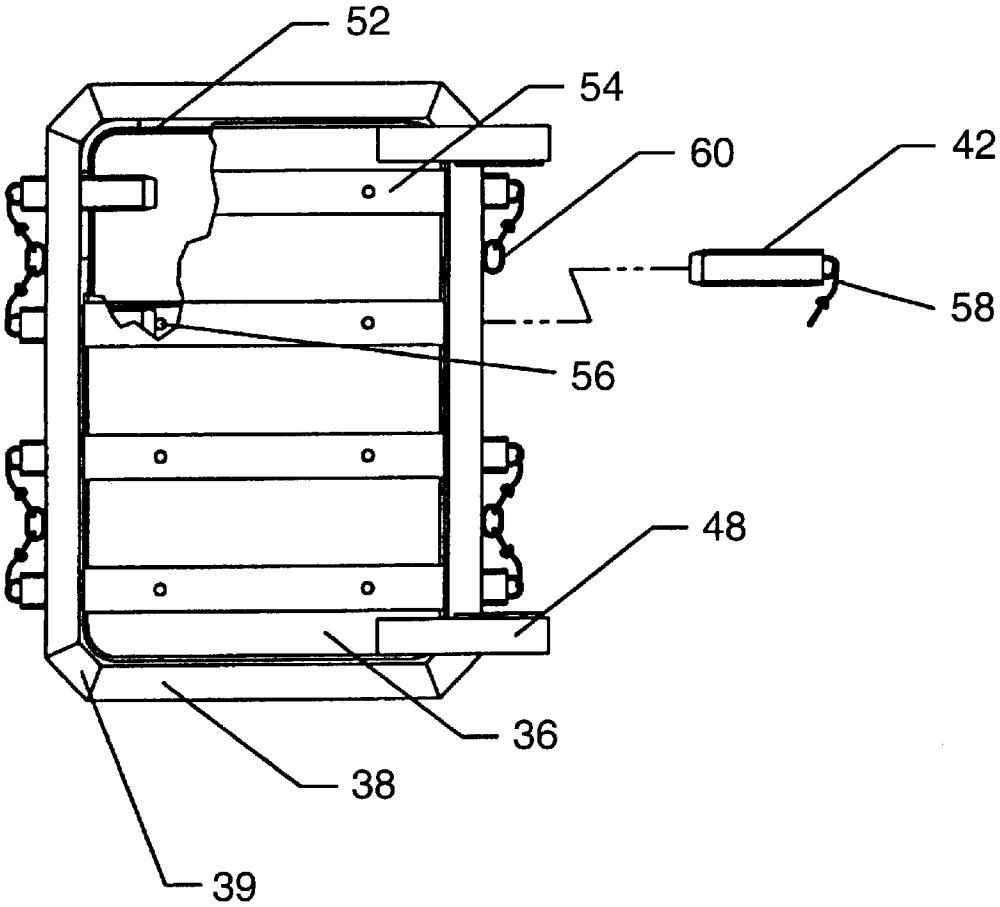
FIG. 13 is a diagrammatic exploded frontal elevation view, partially cut away to reveal some interior detail, of the closure assembly of the inventive embodiment shown in FIG. 1.

As shown in FIG. 10, cavity 34 has a shape which roughly corresponds to the rectangular parallelipiped shape of shell 22. Although two interior corner edges of cavity 34 are shown to be beveled or chamfered, this is not intended to represent a significant inventive feature; rather, such chamfering/beveling is merely accurately reflected in the drawing as a manufacture artifact of the U.S. Navy's inventive prototype. The minimal inventive post-explosion benefits which may be afforded by modifying the configuration of cavity 34 should generally give way to the more important inventive pre-explosion considerations of spatial accomodation for large bomb packages.

Door 36 for doorway 37 conforms with its doorframe (e.g., coaming or other perimetric structure) 38, which is provided with an angled inside corner surface 39 (e.g., miter, chamfer or bevel) at each of its four inside corners. For some inventive embodiments, it may be advantageous to use angled inside corner surfaces 39 which are curvilinear, as opposed to rectilinear as shown.

The U.S. Navy's inventive prototype has a door 36 area measurement (about 655.75 square inches) which is approximately fifty-five percent of the end face 24*b* area measurement (about 1,117 square inches). Door 36 has a door width $W_D$ which is approximately seventy-five percent of the width $W_F$ of end face 24*b*, and a door height $h_D$ which is approximately seventy-five percent of the height $h_F$ of end face 24*b*. These dimensional relationships provide useful general inventive guidelines. For many inventive embodiments, the door and the prismatic base face which incorporates the door should be relatively dimensioned so that the door has an area which is at least about eleven twentieths of the area of the base face; alternatively considered, the door and the base face should have roughly similar shapes wherein the door has a width and height which are each about three-quarters of the length and height of the base face.

Generally speaking, in terms of spatial efficiency, it makes sense in inventive practice for cavity 34 to be in approximate comportment, in terms of shape, breadth and height, with doorway 37; this logic establishes a doorway 37 which permits entrance of the package, as well as a cavity 34 which permits placement of the package. The large access size of doorway 37, together with the roomy accommodation size of cavity 34, permits introduction of an entire large suspect explosive package (e.g., parcel) into inventive explosive containment device 20, thereby obviating the need to remove the bomb from its concealing package.

Many inventive embodiments include wear liner 40 made of a material such as plastic, which at least partially lines (preferably completely lines) cavity 34. The U.S. Navy's inventive prototype includes a wear liner 40 made of polyethylene. Wear liner 40 provides a wear surface to protect foam 32 from damage prior to detonation.

Some inventive embodiments include fragmentation layer 41. Inventive applications involving fragmenting munitions (e.g., pipe bombs, mortars and grenades) will particularly benefit from the presence of fragmentation layer 41. According to this invention, fragmentation layer 41 can be made of any material having satisfactory ballistic performance, such as a metal (e.g., steel or aluminum), or a ceramic or a composite (e.g., 52 glass, kevlar, spectra, etc.). Fragmentation layer 41 can be disposed as a linear for foam 32 either in lieu of wear liner 40 or in addition to (preferably inside of) wear liner 40. Alternatively, for some inventive embodiments fragmentation layer 41 is disposed within foam 32 so as to be sandwiched by the foam 32 material.

Still referring to FIG. 10 through FIG. 12 and FIG.17, and particularly referring to FIG. 13 through FIG. 16, operation of inventive explosive containment device 20 is uncomplicated. Some inventive practitioners may choose to stage inventive device 20 whereby door 36 is unsecured and cavity 34 is empty, this approach may be preferable as expediting implementation of inventive device 20. If door 36 is in a secured condition, eight steel shear dogging pins 42 are removed and door 36 is swung open.

Figure 16:
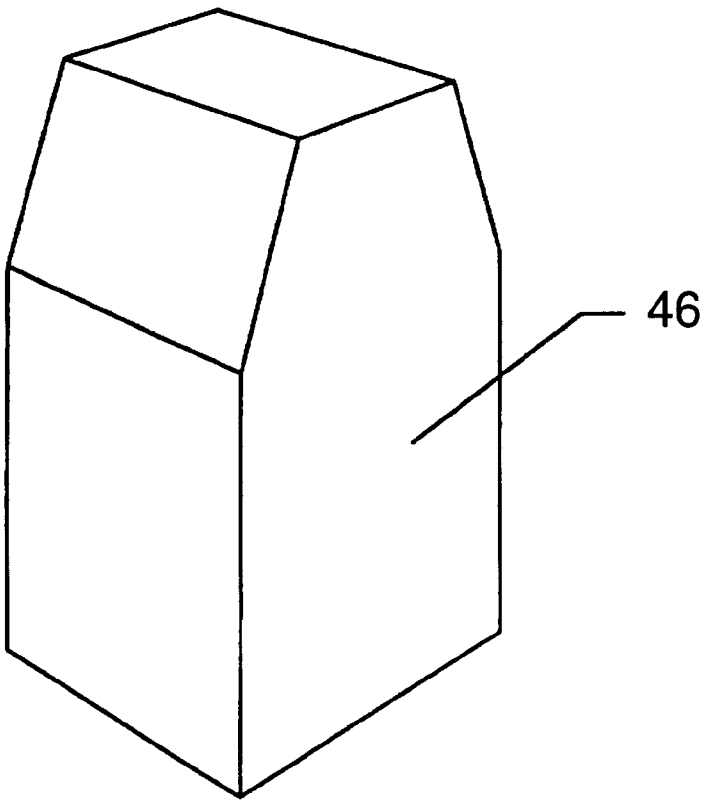
FIG. 16 is a diagrammatic perspective view of an embodiment of a foam billet which can be inventively used for "packing" a suspect explosive object.
Figure 15:
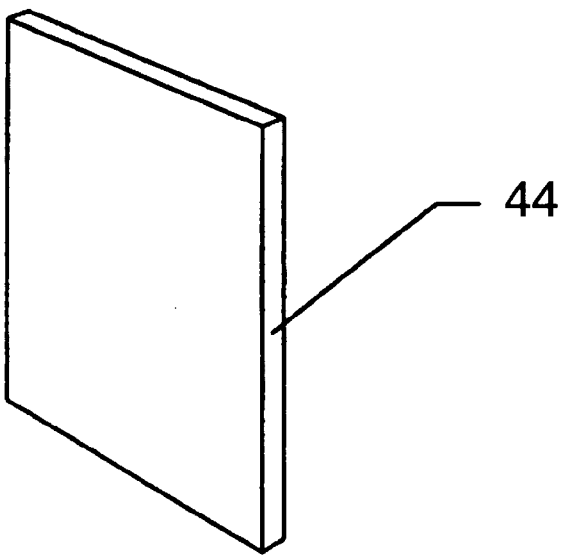
FIG. 15 is a diagrammatic perspective view of an embodiment of a foam plank which can be inventively used for "packing" a suspect explosive object.
Figure 17:
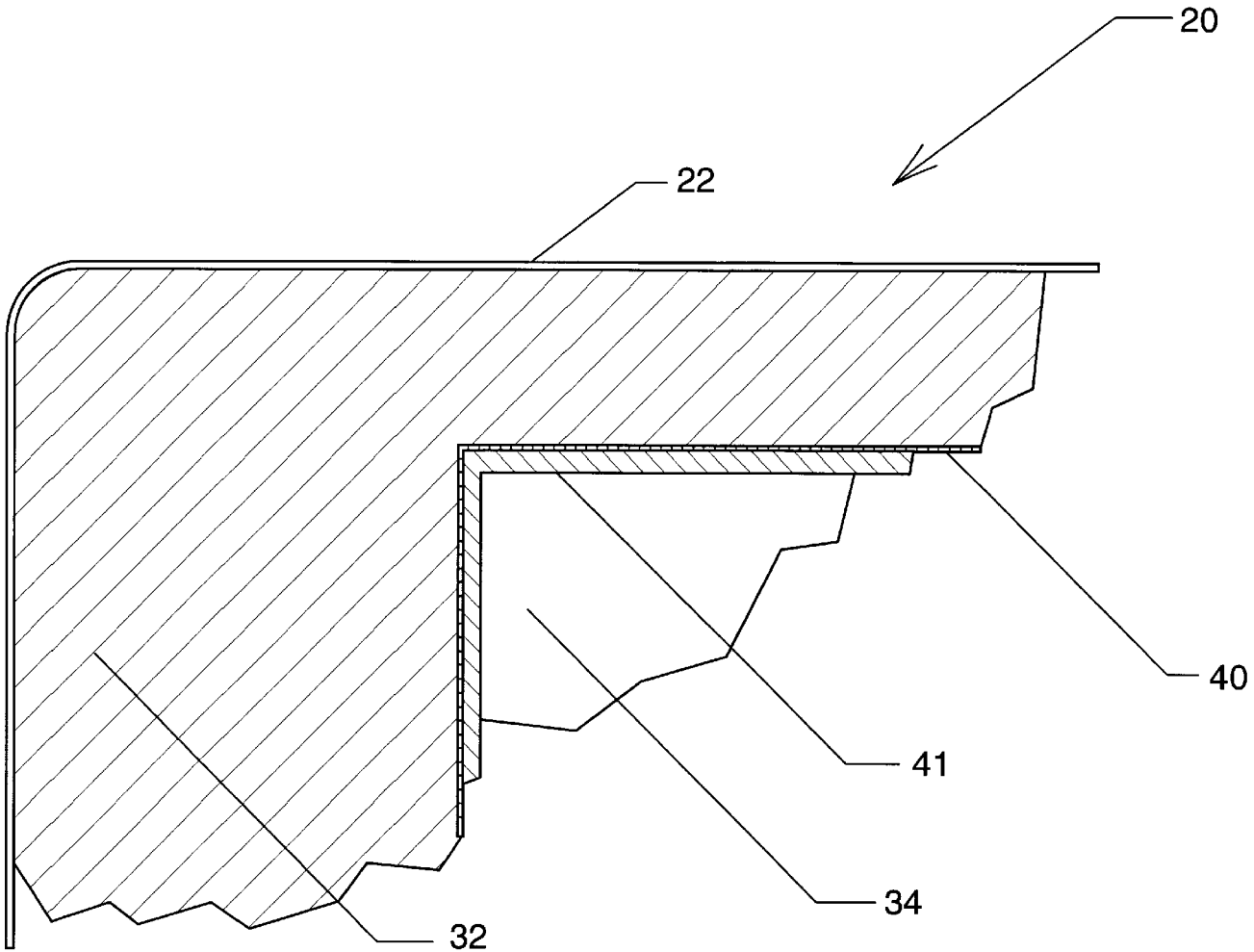
FIG. 17 is diagrammatic cross-sectional top plan view, similar to the view shown in FIG. 12 but partial and enlarged, of the inventive embodiment shown in FIG, 1.

Packing materials (preferably made of rigid foam), such as foam planks 44 shown (one shown) in FIG. 15 and a large foam billet 46 shown in FIG. 16, are utilized for maintaining the explosive object in a stationary position inside chamber 34. The packing materials can be kept inside chamber 34 pending implementation of inventive device 20, or can be conveniently stored elsewhere (preferably nearby). If foam planks 44 and foam billet 46 are found to be in cavity 34, they are removed from cavity 34.

Door 36 swings open and shut via hinge 48. Door (closure) assembly 50 includes door 36, doorframe 38, shear dogging pins 42, hinge 48, lip-seal 52, door stiffeners 54, pin stops 56, dogging pin lanyard clasps 58 and attachment loops 60.

The suspect bomb package is admitted through doorway 37, placed within cavity 34 and slid to the rear of cavity 34. Next, foam planks 44 are loosely installed on both sides of the package (at least one foam plank 44 on each side) to reduce free atmospheric air in inventive device 20 and to prevent shifting during transit. Then, foam billet 46 is slipped into cavity 34 in order to isolate the suspect bomb package from door assembly 50.

Next, door 36 is closed (swung shut) and then secured with the eight steel shear dogging pins 42. Shear dogging pins 42 are slid into engagement with channeled door stiffeners 54; shear dogging pins 42 are passed through channeled door stiffeners 54 until shear dogging pins 42 contact pin stops 56 inside door 36. Shear dogging pins 42 secure door 36 against opening under blast loading.

Finally, dogging pin lanyard clasps 58 are clipped to attachment loops 60 on doorframe 38. Inventive explosive containment device 20, with the suspected explosive object within, is now ready for conveyance. Clipping of lanyard clasps 58 to attachment loops 60 prevents disengagement of shear dogging pins 42 during transport of inventive device 20.

Simple lip-seal 52 around the perimeter of door 36 controls ejection of particulate matter from inventive explosive containment device 20 following a detonation, and allows controlled bleed-down to ambient pressures over a period of about ten to twenty seconds.

The present invention acts to modify the structural loading which metal shell 22 experiences upon the occurrence of a high explosive reaction. To elaborate, let us consider the thermo-chemical progression of a typical high explosive reaction in an air atmosphere. For purposes of discussion, we shall resolve this complex reaction into two idealized phases, viz., (i) an initial phase which is anaerobic in nature, and (ii) an ensuing aerobic phase.

The anaerobic phase involves: the decomposition of the metastable explosive compound; various redox reactions involving the atomic species generated by decomposition of the original explosive compound; and, a multitude of competing equilibrium reactions amongst the detonation products. This anaerobic phase, except for the various equilibrium reactions, entirely occurs during passage of the detonation wave through the explosive compound. This idealized anaerobic phase involves only that mass of matter originally composing the explosive charge.

During the subsequent aerobic phase, oxygen in the neighboring air promotes further oxidation of the detonation products. Typical military high explosives (usually the choice of terrorists) which are detonated in air liberate only 40 to 50 percent of their energy during the anaerobic phase. The remaining 50 to 60 percent of the energy output is released through oxidation of the detonation products during the aerobic phase. Turbulent mixing of the detonation products with the encompassing oxygen-rich atmosphere is imperative for the aerobic phase to occur. Denial of access to ample oxygen impedes the aerobic phase of the reaction. Additionally, the aerobic phase is only self-sustaining when the energy released at the flame front exceeds the activation energy for the succeeding reaction cell. Any influence that drops the available energy at the flame front below this activation energy will quench the reaction. Naturally, any impediment to completion of the aerobic phase diminishes the specific energy output for the high explosive.

It is readily apparent that the total energy output of a high explosive reaction in air is not invariant. While it is usually reasonable to assume maximum yield (complete oxidation) for detonation of high explosives in free air, this frequently does not remain true for detonation of high explosives in confined volumes. For a confined detonation, the total energy output depends upon: the quantity of supplementary atmospheric oxygen available; the degree of mixing between the detonation products and the oxygen; and, success in propagating the after-burn flame front. Sufficient reduction of any of these parameters can cause a drop in the total energy release for the high explosive.

The present invention functions in the manner of a pressure vessel which responds plastically upon the occurrence of the single explosive event for which the particular inventive embodiment has been designed. Inventive explosive containment device 20 features certain mechanisms which reduce the overall load experienced by pressure vessel shell 22. These inventive mechanisms permit utilization of a lighter, thinner steel shell 22 for inventive device 20.

According to a first mechanism which reduces the overall load experienced by pressure vessel shell 22, foam diminishes or modifies the energy released by detonation of an explosive charge by limiting the free oxygen in the immediate vicinity of the explosive charge. Preferred inventive embodiments configure foam 32 so that cavity 34 is sized just large enough to accommodate a suspect package. The remaining volume inside inventive device 20, besides the suspect package, is filled with rigid foam 32 and with foam members such as rigid foam planks 44 and rigid foam billet 46. With little atmospheric oxygen in the vessel, the aerobic phase is incomplete and virtually nonexistent. This reduces the total energy output of the bomb, and thus diminishes the damaging effects of an internal munition reaction.

There is a second mechanism which reduces the overall load experienced by pressure vessel shell 22. This second mechanism involves principles which are familiar to the ordinarily skilled artisan. Through a variety of physical processes, the rigid foam (comprising foam 32 and foam packing members) attenuates the expanding shock front while the rigid foam is crushing. These physical processes include: the mechanical work expended during crushing of the foam; destructive interactions among shock reflections off various particle surfaces within the foam; and, increasing of internal energy of the foam during transit of the shock wave.

The rigid foam is additionally involved in a third mechanism which reduces the overall load experienced by pressure vessel shell 22. The foam positively positions the explosive device at a safe distance from shell 22. This assures that prompt impulsive rupture (shock holing) of shell 22 will not occur.

A fourth mechanism reduces the overall load experienced by pressure vessel shell 22. A drop in confined gas pressure is caused by transfer of thermal energy to the pulverized foam particles. These foam particles act as heat sinks, substantially dropping the temperature of the gaseous detonation products. This large drop of gas temperature causes an attendant drop in gas pressure. This rapid heat transfer owes to the tremendous surface area created during pulverization of foam 32 and the foam packing members. One inventive key to successful effectuation of this phenomenon is use of foam which is rigid and frangible.

In sum, the mechanics of reducing the load on the structural shell are fourfold. Firstly, the foam physically alters the reaction process by eliminating free atmospheric oxygen, the foam thereby reducing the total energy liberated during the reaction. Secondly, the foam acts as a shock attenuator. Thirdly, the foam physically limits the proximate location of the bomb to a safe distance from the shell wall. Fourthly, the pulverized foam functions as a thermal accumulator (heat sink); thermal energy transferred to the heat sink decreases the temperature and thus the pressure of the aggregate gasses in the reaction volume. Structural loading on the pressure vessel shell is diminished because all of these mechanisms occur in a time frame which is contemporaneous with (shorter than or comparable to) the response time of the shell.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. An explosive containment device comprising a nonelastic housing and a rigid foam filling, wherein:

said rigid foam filling provides a cavity;

said nonelastic housing includes door means communicating with said cavity;

said nonelastic housing approximately defines a prism having two base faces, at least three side faces, at least six vertices and at least nine edges;

the number of said vertices is twice the number of said side faces;

the number of said edges is thrice the number of said side faces;

one said base face provides said door means;

said vertices are approximately semi-spherically contoured; and said edges are approximately curvilinearly contoured.

2. An explosive containment device as in claim 1, wherein said two bases faces are each symmetrical about an imaginary center point.

3. An explosive containment device as in claim 1, comprising a liner for said cavity.

4. An explosive containment device as in claim 3, wherein:

said housing has a composition which includes steel;

said rigid foam has a composition which includes polyurethane; and said liner has a composition which includes polyethylene.

5. Apparatus for explosive containment, said apparatus having an interior space, said apparatus comprising an inelastic metallic shell and an inner rigid foam portion which at least partially surrounds said interior space, said metallic shell being substantially box-shaped and including six approximately rectangular faces, twelve curvilinear junctional edges 4nd eight semi-spherical junctional vertices, each said junctional edge adjoining two adjacent said faces, each said junctional vertex adjoining three said junctional edges.

6. Apparatus for explosive containment as in claim 5, wherein said metallic shell is at least partially made of steel.

7. Apparatus for explosive containment as in claim 5, wherein said inner rigid foam portion is at least partially made of polyurethane.

8. Apparatus for explosive containment as in claim 5, comprising a plastic portion which at least partially covers said inner rigid foam portion.

9. Apparatus for explosive containment as in claim 8, wherein said plastic portion is at least partially made of polyethylene.

10. Apparatus for explosive containment as in claim 5, wherein a said face includes an approximately rectangular door for access to said interior space.

11. Apparatus for explosive containment as in claim 10, wherein said door is nearly coextensive with said face which includes said door.

12. Apparatus for explosive containment as in claim 10, wherein said door has a surface area which is at least approximately fifty-five percent of the surface area of said face which includes said door.

13. Apparatus for explosive containment as in claim 10, comprising a hinge for said door, a plurality of pins and a plurality of door stiffeners for engagement with said pins.

14. An explosive containment device as in claim 1, wherein said housing is made of a metallic material selected from the group consisting of metal and metallic composite.

15. An explosive containment device as in claim 1, wherein said housing is made or a non-metallic composite materials.

16. A structural enclosure for containing an explosion, said structural enclosure comprising:

an inelastic metallic case having a substantially parallelepipedal shape which is characterized by six approximately planar approximately parallelogrammic sides, twelve curvilinear edges and eight semi-spherical corners, said metallic case including closure means at one said side; and an internal rigid foam component at least partially bordering a chamber which is rendered accessible by said closure means, wherein, upon said explosion which originates within said chamber, said internal rigid foam component disintegrates and said metallic case inelastically deforms.

17. A structural enclosure as in claim 16, wherein said metallic case is made of a metallic case material selected from the group consisting of metal and metallic composite.

18. A structural enclosure as in claim 17, wherein said metallic case material includes steel and said rigid foam includes polyurethane.

19. A structural enclosure as in claim 16, comprising a plastic wear layer which at least partially lines said chamber.

20. A structural enclosure as in claim 19, wherein said plastic includes polyethylene.

21. A structural enclosure as in claim 16, wherein said closure means includes a door which is approximately planar and approximately parallelogrammic.

22. A structural enclosure as in claim 16, wherein said sides are approximately rectangular.

23. A structural enclosure as in claim 22, wherein:

said closure means includes a door which is approximately planar and approximately rectangular;

said side at which said closure means is located is characterized by a side length and a side width;

said door is characterized by a door length and a door width;

said door length equals at least about 0.75 said side length; and a said door width equals at least about 0.75 said side width.

24. A structural enclosure as in claim 16, comprising a fragmentation layer which is made of a fragmentation layer material selected from the group consisting of metal, composite and ceramic.

25. Method for containing detonation of an explosive device, said method comprising:

(a) providing a substantially box-shaped apparatus having an interior space, said apparatus comprising:

an inelastic metallic shell which includes six approximately rectangular faces, twelve curvilinear junctional edges and eight semi-spherical junctional vertices, each said junctional edge adjoining two adjacent said faces, each said junctional vertex adjoining three said junctional edges, a said face including an approximately rectangular door for access to said interior space; and an inner rigid foam portion which at least partially surrounds said interior space;

(b) placing said explosive device within said interior space; and (c) closing said doors.

26. Method for containing detonation as in claim 24, comprising:

placing at least three foam packing members within said interior space prior to performing step (c); and securing said door subsequent to performing step (c).

* * * * *